US005722280A

United States Patent [19]

Bodnar

[11] Patent Number: 5,722,280

[45] Date of Patent: Mar. 3, 1998

[54] TWO STAGE DIE SET

[76] Inventor: Ernest Robert Bodnar, 2 Danrose Crescent, Don Mills, Ontario, Canada, M3B 3N5

[21] Appl. No.: 822,181

[22] PCT Filed: Jul. 9, 1994

[86] PCT No.: PCT/CA93/00284

§ 371 Date: Jan. 6, 1995

§ 102(e) Date: Jan. 6, 1995

[87] PCT Pub. No.: WO94/01233

PCT Pub. Date: Jan. 20, 1994

Related U.S. Application Data

[63] Continuation of Ser. No. 360,790, Jan. 6, 1995, abandoned.

[30] Foreign Application Priority Data

Jul. 10, 1992 [CA] Canada ..... 2073650

[51] Int. Cl.[6] ..... B21D 28/12

[52] U.S. Cl. ..... 72/186; 72/335

[58] Field of Search ..... 72/184, 190, 327, 72/328, 335, 185, 186

[56] References Cited

U.S. PATENT DOCUMENTS

| | | | |
|---|---|---|---|
| 3,146,749 | 9/1964 | Heinle | 72/335 |
| 3,222,968 | 12/1965 | Larson | 83/128 |
| 3,943,745 | 3/1976 | Paul | 72/328 |
| 4,956,989 | 9/1990 | Nakajima | 72/327 |
| 5,040,397 | 8/1991 | Bodnar . | |
| 5,075,951 | 12/1991 | Schurr et al. | 72/335 |

FOREIGN PATENT DOCUMENTS

| | | | |
|---|---|---|---|
| 60-166125 | 8/1985 | Japan . | |
| 60-166125 | 12/1985 | Japan . | |
| 62-77124 | 4/1987 | Japan | 72/327 |
| 1055201 | 1/1967 | United Kingdom . | |

*Primary Examiner*—Lowell A. Larson
*Attorney, Agent, or Firm*—Jon Carl Gealow

[57] ABSTRACT

A two stage die set for sequentially blanking an opening in a work piece, and thereafter forming edges of the work piece around the opening and having a male die assembly, having a male blanking die, a male forming die spaced from the male blanking die, and a recess therebetween, a female die assembly having a generally hollow female die sleeve, the die sleeves being shaped and dimensioned to correspond to the shape of the male blanking die and to receive it in telescopic relation, a moveable support plate located around the female die sleeve the moveable plate being biassed so as to urge it into a first extended position, and the moveable plate yielding to the male forming die of the male die assembly, when the male and female dies are closed together, so that the male blanking die, in co-operation with the female die sleeve blanks out a portion of a work piece and forms an opening, and upon further relative movement between the male and female dies towards one another, the male forming die co-operates with moveable plate and the female die sleeve, to cause deformation of an edge portion of the work piece around the opening.

14 Claims, 6 Drawing Sheets

TWO STAGE DIE SET

This is a continuation of application Ser. No. 08/360,790, filed Jan. 6, 1995, now abandoned.

TECHNICAL FIELD

The invention relates to a die set for processing a work piece, in two stages in a single die, and in particular to a die set for use in a rotary die apparatus for first of all blanking out an opening, and then forming edge formations in the work piece around the opening.

BACKGROUND ART

In various work piece processing operations, and in particular in the processing of sheet metal, it is frequently desirable to form openings in a work piece, and then to form a variety of formations around the edge of the opening.

In the past, traditional engineering has generally dictated that these two steps be carried out in two separate dies sets. In certain cases progressive dies have been used, in which a series of dies treat the same work piece, and the work piece moves in an intermittent start stop fashion through the progressive dies. In other proposals, a work piece of a predetermined size is inserted into a die. In a first operation the edge of the work piece is trimmed, and then the die descends further and forms the rest of the work piece.

This process is relatively slow however and is unsuitable for many applications.

Still other proposals have been made in which a work piece is punched out of the sheet, and the punched out piece is then worked in the same die. Again this is a relatively slow process.

It is desirable as far as possible to speed up the processing of a metal work piece, thereby reducing its cost.

This is particularly true in the case of a rotary apparatus for processing a work piece on a continuously moving line. Such rotary apparatus is disclosed in U.S. Pat. No. 5,040,397, inventor Ernest R. Bodnar.

In such an apparatus a plurality of die sets are mounted on respective upper and lower die supports on respective upper and lower rollers. The sheet metal work piece passes between the two rollers and is processed by the die sets.

The operation of the dies on the work piece or sheet metal must therefore be carried out at high speeds so that the line can be run at an economical speed.

A typical product manufactured on such a line is shown in U.S. Pat. No. 4,793,113, inventor Ernest R. Bodnar. It will be observed that the products illustrated in the second patent comprise a series of openings formed through a work piece, and flanges formed around the openings. Longitudinal bend formations are formed in the product, but these of course would be formed by conventional roll forming dies.

If old technology single stage dies were used on the rotary apparatus, to make this product, then it was necessary to provide two rotary stations, the first to form the openings and the second to form the edge flanges. In practice, since the openings in the product of U.S. Pat. No. 4,793,113 were relatively close together it was necessary to have four such rotary stations.

This involved extra expense and also involved the necessity to carefully register the locations of the dies relative to one another by spacing the rotary units precisely, so as to ensure that the second die, forming the edge registered precisely with the opening formed by the first die.

While this was entirely feasible and was in fact done with some degree of commercial success, it was an expensive solution to the problem.

Japanese Patent No. 60-166125 discloses a burring method of ceiling board of container.

According to this method, a ceiling board is placed on a lower die and an upper die is lowered. A pressing projection at a lower end of the upper die presses the ceiling board, and the inside of the board is pushed up by a die. A bulged part is formed on the ceiling board. The upper die is further lowered, and a circular hole is pierced in the bulged part. The die goes into a gap in the upper die, and a flange fixing part is formed.

However, there is no disclosure of an ejector and a passage way in the die set in this Japanese Patent for ejecting blanked out portions of work pieces.

Furthermore, there is no disclosure of a two stage die set for use in combination with a rotary apparatus for high speed continuous blanking, punching, forming or shearing of work pieces, and for continuous ejecting blanked out portions of work pieces.

DISCLOSURE OF THE INVENTION

With a view to overcoming the various disadvantages noted above, the invention comprises a two stage die set for sequentially blanking an opening in a work piece, and thereafter forming edge formations on said work piece around said opening and comprising a male die assembly, in turn comprising a male blanking die member defining a male blanking edge, a male forming die member spaced from said male blanking die member defining a male forming corner, recess means between said blanking die and said forming die, a female die assembly in turn comprising a generally hollow female die sleeve member, said female die sleeve member being shaped and dimensioned to correspond to said male blanking die member and to receive the same in telescopic relation and defining inner and outer sides, blanking edge means on the inner side of said female die sleeve, forming corner means on the outer side of said female die sleeve, a moveable female support plate means located around said outer side of said female die sleeve member, and pressure means operable on said moveable female support plate means, whereby to urge the same into a first position, and said moveable plate means being adapted to yield to said male forming die member of said male die assembly, when said male and female dies are closed together, whereby said male blanking die co-operates with said female die sleeve of said female die assembly to blank out a portion of a work piece and form an opening therein, and whereby upon further relative movement between said male and female die assemblies towards one another, said male forming die sleeve will co-operate with said moveable support plate means and said female die sleeve, to cause deformation of an edge portion of said work piece around said opening, ejector means in said male blanking die member, said ejector means being resiliently movable, whereby the same may be withdrawn into said blanking die member, upon closure of said blanking die member on said work piece, and, after blanking of said portion of said work piece by said male and female die members, said ejector means being adapted to be extended from said male blanking die, whereby to displace said blanked out portion, and, passageway means in said female die assembly communicating with the interior of said female die sleeve for receiving said blanked out portion of said work piece, whereby the same may be disposed of through said passageway means.

The invention further comprises such a two stage die set and wherein said female die assembly includes a movable support plate means is in the form of a generally rectangular plate, edge rib means on said plate, extending outwardly from opposite sides of said plate, and a pair of retaining rails, defining retaining ribs interengaging with said edge ribs, said retaining rails defining spaces enclosed by said retaining ribs, whereby said edge ribs may move relative thereto within said spaces.

The invention further comprises such a two stage die set and including die support means for supporting said male and female die assemblies, recess means in said die support means, and spring means extending between said recess means and said male die assembly and spring means extending from said recess means and said female die assembly, and means for securing respective said male and female die assemblies to respective said support means.

The invention further comprises in combination with a rotary apparatus having upper and lower rotary members, and having at least one generally semi-cylindrical die support member in each of said upper and lower rotary members, and wherein said male die assembly is supported on said semi-cylindrical die support member of said upper rotary member and wherein said female die assembly is supported on said semi-cylindrical die support member of said lower rotary member, and including upper spring recess means in said upper semi-cylindrical die support member, and including lower spring recess means in said lower semi-cylindrical die support member.

The invention further comprises such a two stage die set and including slug ejection opening means in said lower semi-cylindrical die support member for receiving a slug from said female die, and ejecting the same.

The invention further comprises such a two stage die set and wherein said female die sleeve includes a female hollow die sleeve, of regular section from top to bottom, and a female die base sleeve, defining ledge means engaging the lower end of said hollow die sleeve, and opening means in said die base member registering with said hollow female die sleeve, said die base member being attachable to said die support member, for supporting said hollow die sleeve in position, and securing means for securing said hollow die sleeve to said die base member.

The invention further comprises such a two stage die set wherein said female die sleeve defines in plan, a shape having at least some linear portions and having radiussed corners joining said linear portions, and wherein said linear portions define a predetermined first width, and wherein said radiussed corners define a predetermined second width less than said first width.

The invention further comprises such a two stage die set wherein said female die sleeve defines a predetermined first height, and wherein said movable support plate means, in its said first position, defines a predetermined second height, greater than said first height, whereby upon closing of said male and female die assemblies, said work piece is initially clamped between said male forming die member and said movable support plate means, just prior to blanking of said opening.

The invention further comprises such a two stage die set, and wherein said die base member defines a generally frustoconical shape, and wherein said movable plate means defines an interior generally frustoconical recess, shaped to substantially correspond to said frustoconical shape of said die base, whereby said mounting plate means may be moved over and around said die base means.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

MODES OF CARRYING OUT THE INVENTION

Figure 1:
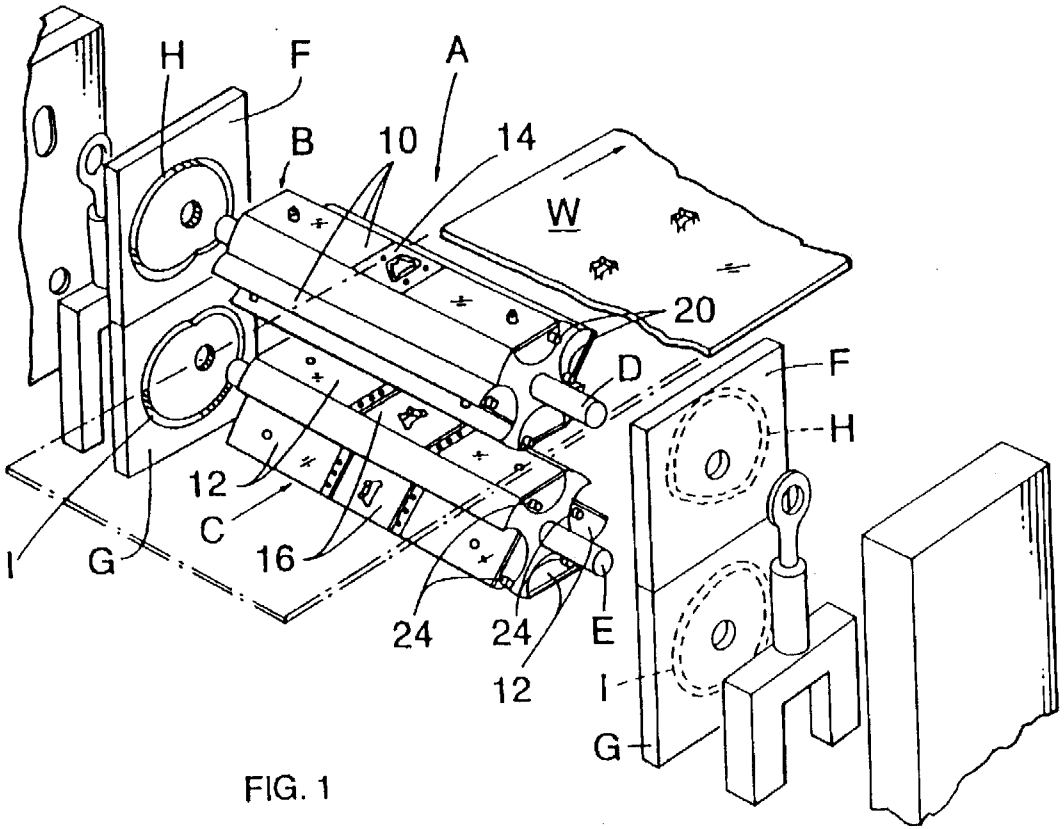
FIG. 1 is a schematic exploded perspective illustration of a rotary apparatus incorporating the two stage die sets of the invention.

Referring first of all to FIG. 1; it will be seen that this illustrates a rotary apparatus as described in U.S. Pat. No. 5,040,397 of E. R. Bodnar referred to above to which the two-stage die sets of the invention are attached.

As will be well understood from studying the patent, such rotary die supports will close and open on a work piece at a relatively high rate of speed. For example, it is anticipated that the line speed of such a rotary forming line would be upwards of 300 feet per minute or more.

Since the openings being formed in a work piece, moving at this speed, will in most cases be only fractions of an inch apart, in some cases it will be appreciated that the rotary apparatus will be rotating at a high rate of speed and the dies will be closing and opening with great rapidity.

This however is merely mentioned by way of preliminary remarks. It will be appreciated that the invention described herein will be applicable to a great many situations both in rotary apparatus and also in other forms of reciprocating punch presses of conventional design. However, in such punch presses, the use of the invention will enable significant advantages both in the reduction of the number of operations required on a work piece and also in speeding up the production to a very significant degree. Thus, while the invention is described in general terms in relation to its use in a rotary apparatus as referred to above, the invention is not in any way to be considered as confined solely to use in a rotary apparatus, but will be of application in a wide variety of processing applications for processing a work piece where two operations are to be performed sequentially at high speed, in a single die set whether on a conventional press, or on a rotary apparatus.

In addition, it will be appreciated that there are presses known as "flying dies" in which dies which are initially stationary are accelerated up to the speed of a moving work piece and are then closed and opened again, and are returned back to their at rest position, with this function being repeated over and over again as the work piece moves along. Dies sets of the type of the present invention could also be applicable to such flying dies.

Consequently, it will be appreciated that the invention is related generally to dies performing a two stage operation at relatively high speed a single die set, whether such dies are in a conventional press, or a flying die, or in a rotary apparatus.

Furthermore, while reference has been made herein repeatedly to operations on sheet metal, it will be appreciated that such dies may be required to process a variety of different types of material, and therefore the reference to sheet metal is merely by way of example, for the sake of explanation, and without limitation. Such dies may be utilized for many different applications on many different forms of material.

Referring to FIG. 1, it will be seen that the rotary apparatus which is illustrated generally as A comprises upper and lower roll units B and C, supported on shafts D and E in respective end plates F and G.

Upper and lower die supports 10 and 12 are of generally semi-cylindrical shape in section, and are supported in the upper and lower roll units so that they may partially rotate relative thereto as the upper and lower roll units rotate.

Guide pins 20 and 24, at opposite ends of the die supports 10 and 12 are guided in grooves H and I in end plates F and G.

The work piece is illustrated as W, and moves in the direction of the arrow between the upper and lower roll units.

Figure 1A:
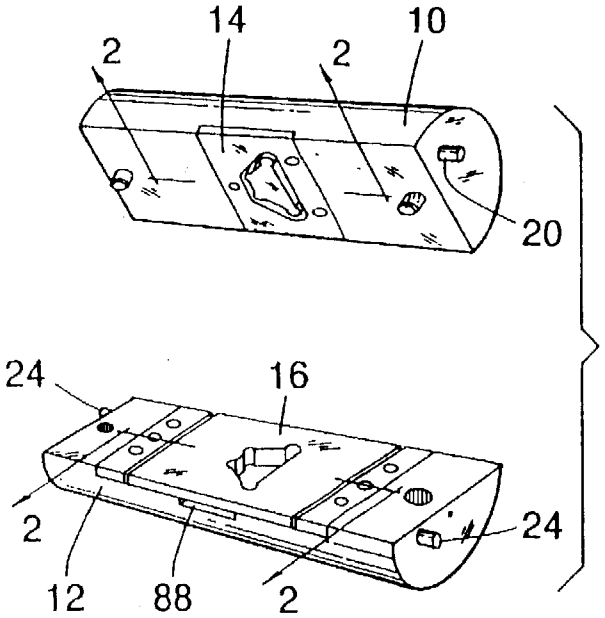
FIG. 1A is a schematic perspective illustration of a pair of upper and lower die support members, showing the upper and lower male and female die assemblies of the die set in accordance with the invention.

Turning to FIG. 1A, it will be seen that the semi-cylindrical upper and lower die supports 10 and 12 are shown as supporting a die set comprising respective male and female die assemblies 14 and 16. The die supports 10 and 12 are shown as being guided by respective guide pins 20 and 24. The function of such guide pins is described in the aforesaid U.S. Letters Patent, and further description is omitted from this application, since it is superfluous. Essentially the purpose of such guide pins is to ensure that the die supports, and die assemblies 14 and 16, are moved into a horizontal spaced apart parallel position just prior to closing, during closing and just after opening, so as to ensure that the die assemblies 14 and 16 register precisely with one another.

However, all of this is explained in the aforesaid U.S. Letters Patent, and no further description is given herein.

The registering of upper and lower die assemblies is well-known to be essential to the satisfactory operation of dies both in conventional presses, and in flying dies, and means for registration in those situations, are well-known in the art.

Figure 2:
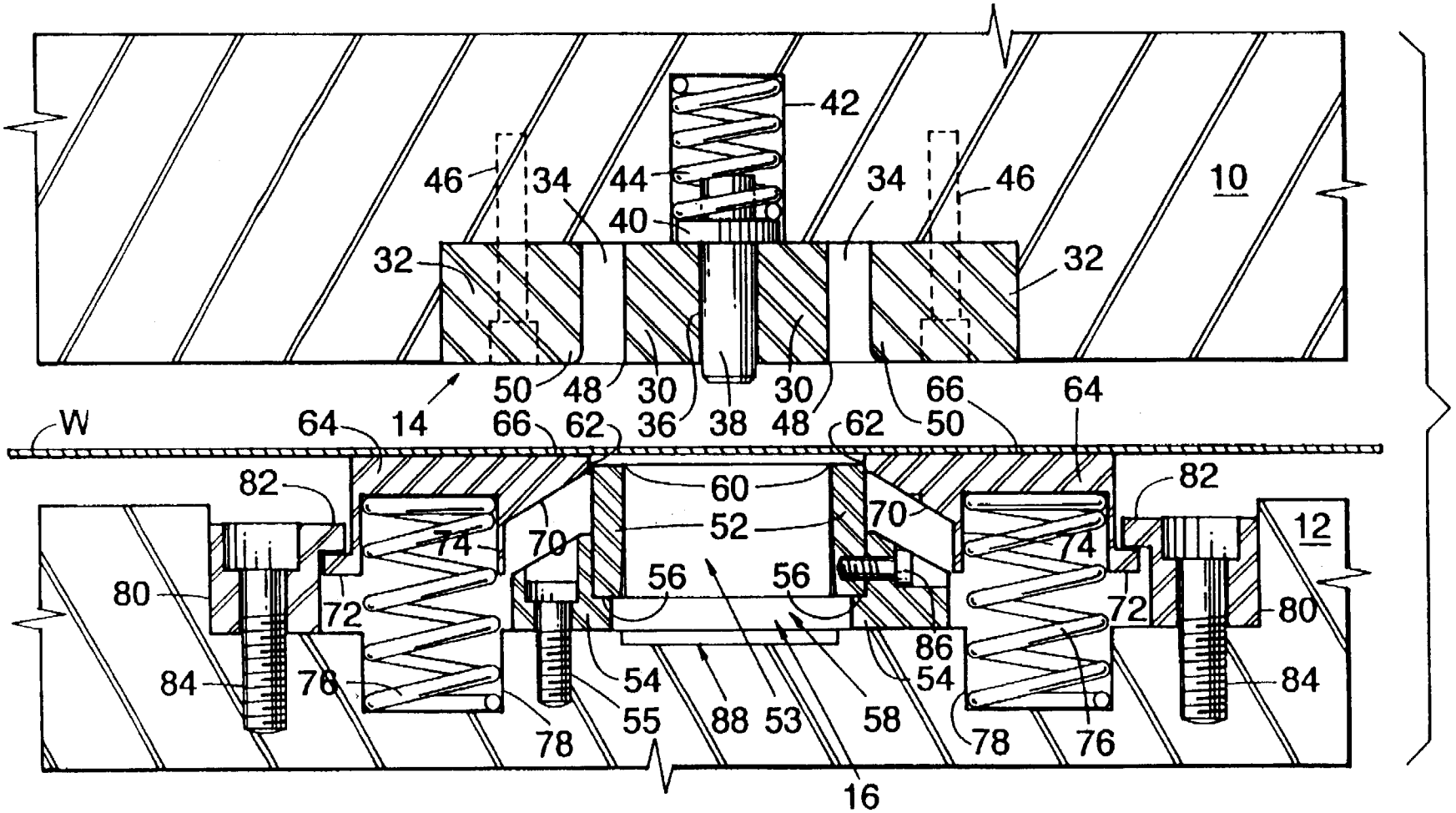
FIG. 2 is a section along the line 2—2 of the male and female die set, showing it in an open position just prior to closing on a work piece.

Referring now to FIG. 2, it will be seen this is sectioned along the line 2—2 of the die set 14–16 just prior to closing.

The die assemblies 14 and 16 are shown associated with die supports partially illustrated as 10 and 12. However, as explained above,. this is purely by way of illustration and without limitation, since such die assemblies 14 and 16 could be used and supported otherwise than with the semi-cylindrical die supports 10 and 12.

Referring first of all to the male die assembly 14 it will be seen to comprise a central male blanking die member 30, and a male forming die member 32.

Figure 6:
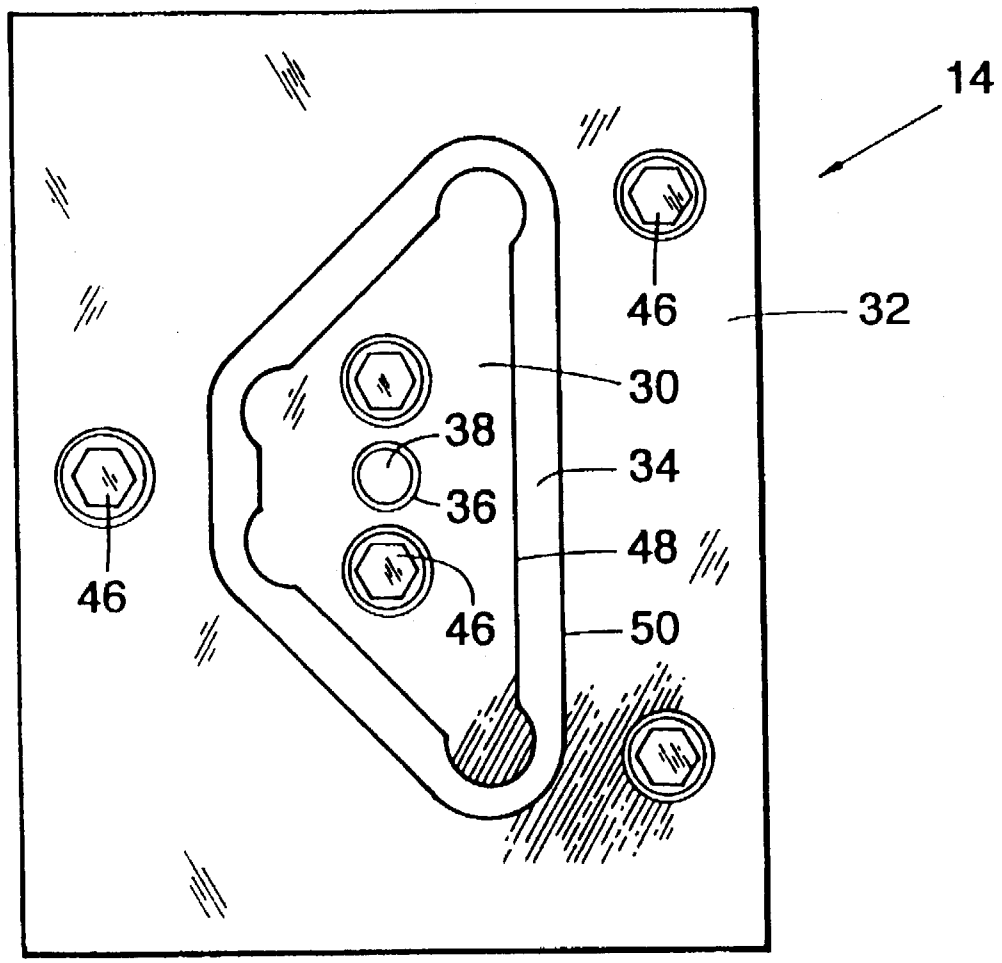

The shapes of the dies 30 and 32 are shown in FIG. 6, and will depend on the shape of the opening to be blanked, and on the shape of the edge formations to be formed.

A space 34 is defined between the male blanking die member 30 and the male forming die member 32. One or more central openings 36 are provided in the blanking die 30 (see FIG. 6). One or more ejector pins 38 are located in such openings 36. The ejector pins 38 have collars 40, and are adapted to slide in recesses 42. In this embodiment recesses 42 are formed in the die support 10, although clearly they could be formed in some other block or support (not shown) in another application.

Within the recesses 42 there are located springs 44, adapted to urge the ejector pins 38 outwardly for reasons to be described below.

The male forming die 32 is secured, in this case to the die support 10, by bolts 46. The male blanking die 30 is secured to the die support 10 by bolts 46 (FIG. 6).

The blanking die 30 defines blanking edges 48—48. The forming die 32 defines radiussed forming corners 50—50.

Referring now to the lower or female die assembly 16, this will be seen to comprise a female die sleeve 52, defining a hollow interior 53 supported on a base member 54. Base member 54 is secured by bolts 55 to support 12, and defines ledges 56 for engaging the lower end of the sleeve 52. The base member 54 defines an opening 58 which is of greater size than the hollow interior 53 defined by the sleeve member 52 for reasons to be described.

The sleeve member 52 defines a blanking edge 60, around its inner side, and defines a forming corner 62, around it outer side.

Figure 3:
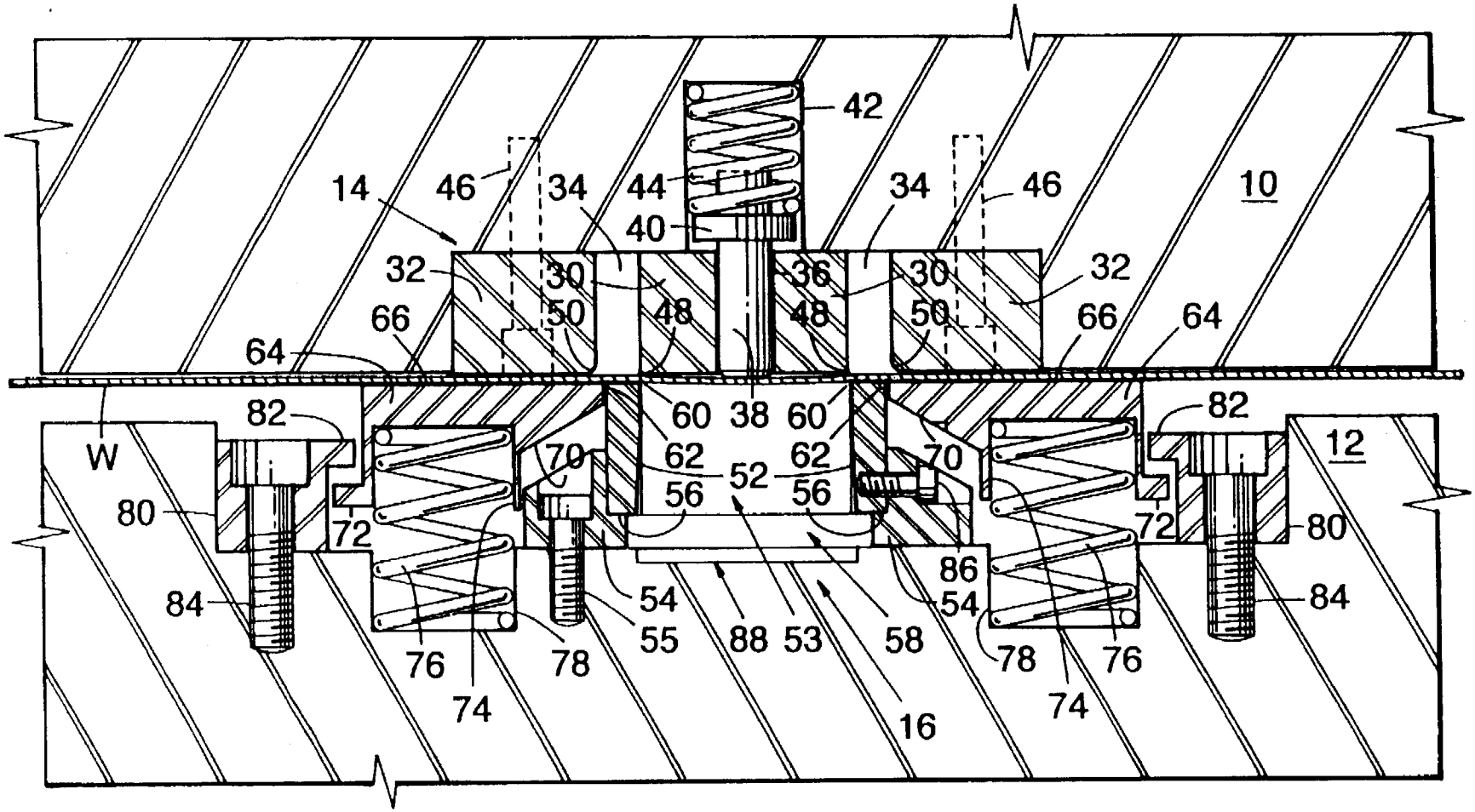
FIG. 3 is a section corresponding to FIG. 2, showing the die set in a first partially closed position, blanking out a slug from a work piece.

The blanking edge 60 co-operates with the blanking edge 48 of the male blanking die 30 of the male die assembly 14, to blank out a slug portion of a work piece and form an opening, the work piece being indicated generally as W, when the dies move towards one another (FIG. 3). It will be appreciated that in the embodiment shown in FIG. 1, the two die assemblies move towards one another essentially simultaneously from opposite sides of the work piece. However this will not always be the case, in many cases the female die assembly 16 will be in a fixed location and the male die assembly 14 will be in some form of movable press, so that the male die assembly will move relative to the female die assembly, while the female die assembly remains stationary.

However, this does not affect the operation of the invention, and is merely mentioned here for the sake of clarification.

In order to form the edges of the work piece around the opening blanked out by the blanking edges 48 and 60, a movable female support plate 64 is located around the outside of the female die sleeve 52. Movable support plate 64 comprises an upper generally planar surface 66, and a lower frustoconical shaped surface 70 adapted to accommodate the shape of the base 54. The outer periphery of the support plate 64 is generally of vertical shape, and defines edge ribs 72—72. Within the moveable support plate 64 there are defined a plurality of, in this case six, spring recesses 74—74. Springs 76—76 are received within recesses 74—74. Springs 76—76 are further received in recesses 78—78, located, in this case, in the semi-cylindrical die support 12.

It will be appreciated that the springs could be accommodated in recesses in other forms of support means (not shown) other than the semi-cylindrical supports 12, as described above, where such die sets are used in other forms of presses such as flying dies or conventional presses.

Springs 76 urge the plate 64 upwardly towards the male forming die 50 of the male die assembly 14.

In its extended position (FIG. 2) the plate 64 is extended somewhat higher than the top of sleeve 52.

Upward movement is restricted by means of the side rails 80—80. Side rails 80—80 have retention ribs 82—82 engaging the edge ribs 72—72. Rails 80—80 define spaces below the ribs 82—82 within which the ribs 72—72 can move downwardly and upwardly in a manner described below.

Rails 80 are secured for example by means of bolts 84, to the semi-cylindrical die support 12.

The female die sleeve 52 is secured in the base 54 by means of a one or more set screws 86, so that the female die sleeve 52 is held securely in position.

A passageway 88 in support 12 communicates with the die base, to discharge the slug S to the exterior.

In operation, starting with FIG. 2, a work piece W is assumed to be passing through the male and female die assemblies 14 and 16, and the male and female die assemblies 14 and 16 are assumed to be moving, at the same speed as the work piece W. It will of course be appreciated however that this is true only in the case of for example rotary apparatus such as that described, and flying die apparatus.

At this stage the movable forming support plate 64 is located above the plane of edges 60 and 62 of the female die sleeve 52.

In the case of a conventional press, the work piece W would not be moving but would simply be placed in position and would be stationary.

The male and female die sets 14 and 16 then move to close relative to one another. As explained they move together in the rotary apparatus. However, one of the die sets may move relative to the other while the other remains stationary, in other presses.

The next stage is as shown in FIG. 3, with the die sets partially closed. During this time the male forming die 32 of the male die assembly 14 will engage the work piece, on one side, and the moveable support plate 64 of the female die assembly 16 will engage it on the underside, thus securely gripping the work piece. This occurs before engagement of the male and female dies 30 and 52. Subsequently it will be seen that the moveable support 64 moves downwardly and the edges 48 and 60 engage the work piece W in such a manner as to blank out a slug S of material. During this brief moment, the ejector pin 38 will be seen to have been retracted somewhat into the recess 42, against the pressure of spring 43.

Figure 4:
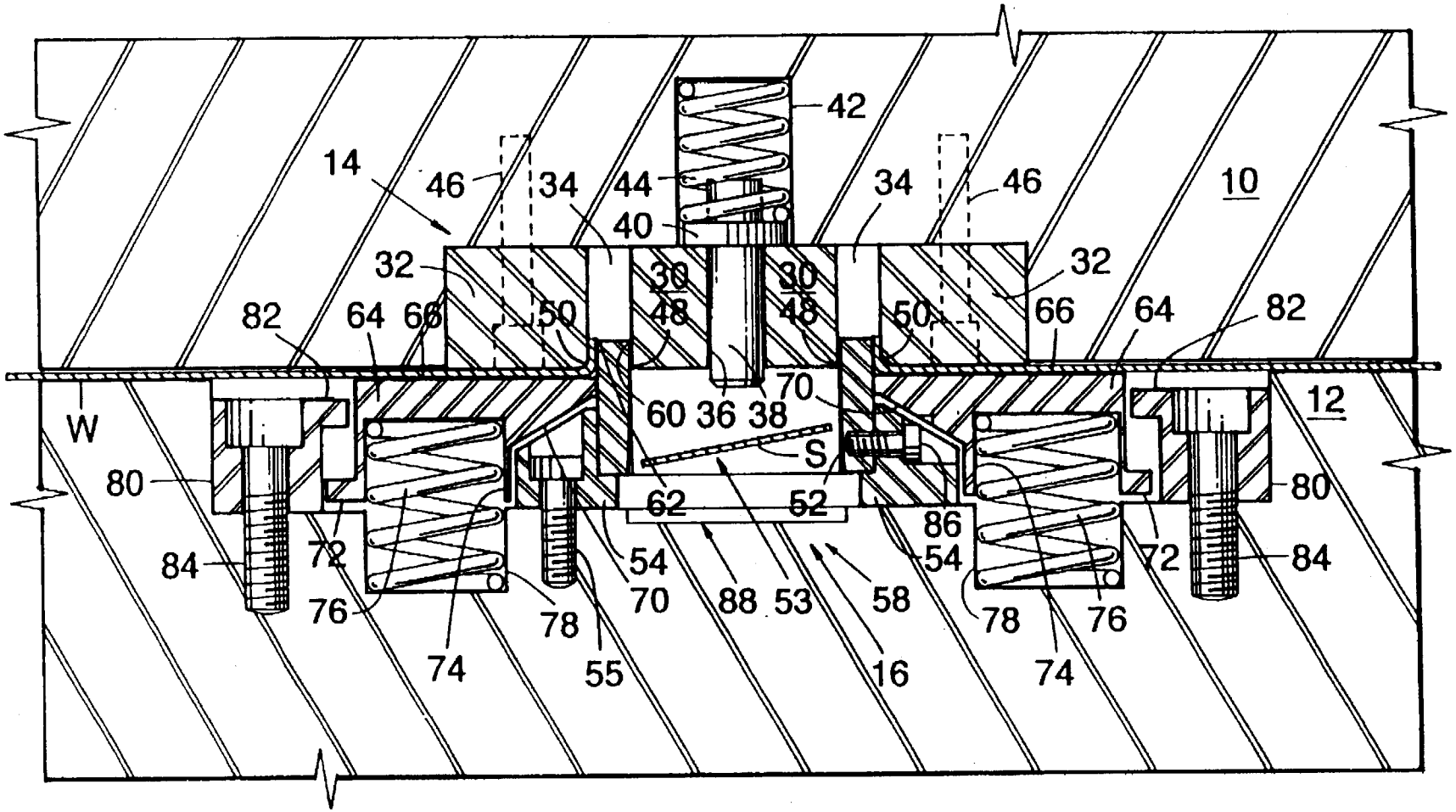
FIG. 4 is a section corresponding to FIGS. 2 and 3 showing the die set in a third position, forming the edges of the work piece around the opening formed in FIG. 3.

Once the blanking out operation has taken place, which will take place in a fraction of a second, in most cases, then the ejector pin 38 will be urged downwardly by the spring 43 and will eject the slug, as shown in FIG. 4.

Continued relative movement of the die assemblies will then cause the movable forming plate 64 to be retracted further against the pressure of the springs 76. The radiussed corners 50 and forming edges 62 of the respective male forming die 32 and female die sleeve 52 will then cause the edges of the work piece around the opening formed in the work piece, to be turned upwardly as at U in FIG. 4.

The female die sleeve will be seen to be received in the spacing 34 between the male blanking die 30 and the male forming die 32.

The slug S will be seen falling through the hollow interior 53 in the female die sleeve 52, and the ejector pin will be seen to be extended from the male die 14.

Continued rotation of the upper and lower rotary units will cause relative movement of the male and female die sets 14 and 16 causing them to open up. This will release the movable support plate 64 from the pressure of the male forming die 50, and springs 76 will urge the support plate 64 upwardly once more into the position shown in FIG. 2. This will then cause the work piece W and edges E to be displaced upwardly from the female sleeve die member 52, thereby permitting the work piece W to move continuously, without interrupting the smooth flow of movement of the production line.

It will be appreciated that when engineering the design of a particular die set and, the space 34 between the male blanking die 30, and the male forming die 32, allowance must be made for the thickness of the work piece W, which will be turned upwardly between the forming corners 50–62 of the male forming die 52 and the female die sleeve 32 respectively. This will be understood readily by an examination of FIG. 4. Thus the opening or spacing 34 will be slightly greater than the width of the female die sleeve 32 of the female die set 16.

As will be understood, the forming corners 50 and 62 will have a profile suitable to form the shape desired for the edge E, and a radius appropriate to the type of material being formed.

Figure 5:
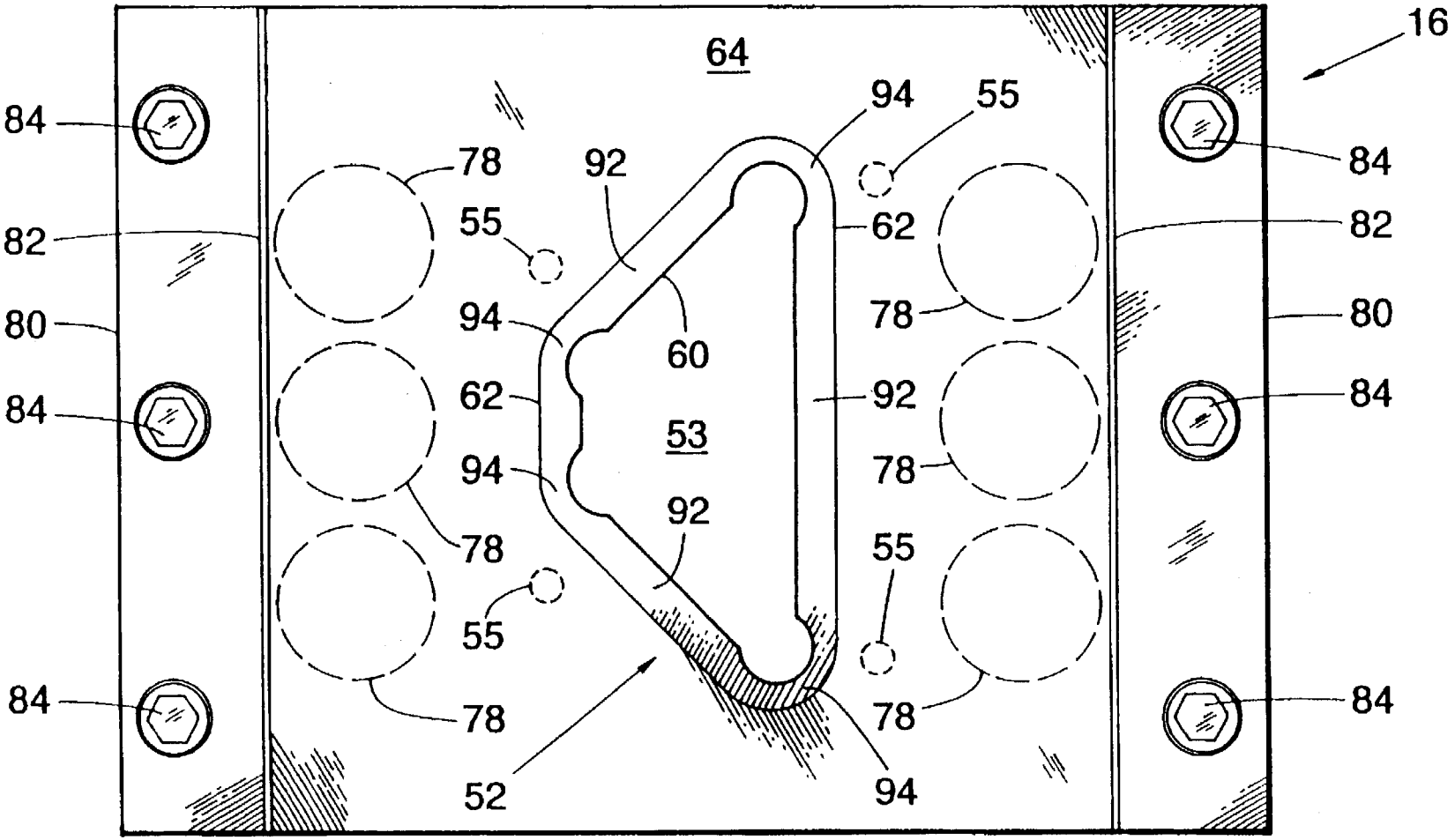
FIG. 5 is a plan view of the female die assembly, showing various portions in phantom, and, FIG. 6 is a plan view of the male die assembly.

Referring to FIGS. 5 and 6, the female and male dies are shown in plan.

In the particular die illustrated in this description, the shape of the die is best shown in FIGS. 5 and 6.

FIG. 5 illustrating the female die assembly shows the female die sleeve 52 as having linear portions 92—92—92 joined by curved or radiussed corners 94—94—94—94. It will be noted that the linear portions 92 define a predetermined first width, and that the radiussed corners define a predetermined second width less than said first width. This produces advantageous results in the particular product, such as that illustrated in the aforesaid U.S. Letters Patent. However, it will be appreciated that the design and shaping of the female die will be dependant upon the engineering of the particular product being made, and this is illustrated here by way of example.

The foregoing is a description of a preferred embodiment of the invention which is given here by way of example only. The invention is not to be taken as limited to any of the specific features as described, but comprehends all such variations thereof as come within the scope of the appended claims.

I claim:

1. A two stage die set for use in a rotary apparatus, having upper and lower rotary members, and having at least one generally semi-cylindrical die support member in each of said upper and lower rotary members, for sequentially blanking an opening in a work piece, and thereafter forming edge formations on said work piece around said opening and being characterized by:

a male die assembly (14), in turn comprising a male blanking die member (30) defining a male blanking edge (48);

a male forming die member (32) spaced from said male blanking die member (30) defining a male forming corner (50);

recess means (34) between said blanking die (30) and said forming die (32);

a female die assembly (16) in turn comprising a generally hollow female die sleeve member (52), said female die sleeve member (52) being shaped and dimensioned to correspond to said male blanking die member (30) and to receive the same in telescopic relation and defining inner and outer sides;

wherein said male die assembly (14) is supported on said semi-cylindrical die support member (10) of said upper rotary apparatus and wherein said female die assembly (16) is supported on said semi-cylindrical die support member (12) of said lower rotary apparatus, and having upper spring recess means (44, 42) in said upper semi-cylindrical die support member (10), and including lower spring recess means (76, 78) in said lower semi-cylindrical die support member (12);

blanking edge means (60) on the inner side of said female die sleeve (52);

forming corner means (62) on the outer side of said female die sleeve (52);

a moveable female support plate means (64) located around said outer side of said female die sleeve member (52), and pressure means (76) operable on said moveable female support plate means (64), whereby to urge the same into a first position, and said moveable plate means (64) being adapted to yield to said male forming die member (32) of said male die assembly (14), when said male and female dies (14, 16) are closed together, whereby said male blanking die (30) co-operates with said female die sleeve (52) of said female die assembly (16) to blank out a portion of a work piece (W) and form an opening therein, and whereby upon further relative movement between said male and female die assemblies (14, 16) towards one another, said male forming die sleeve (32) will co-operated with said moveable support plate means (64) and said female die sleeve (52), to cause deformation of an edge portion of said work piece (W) around said opening;

wherein said female die sleeve (52) defines a predetermined first height, and wherein said movable support plate means (64), in its said first position, defines a predetermined second height, greater than said first height, whereby upon closing of said male and female die assemblies (14, 16), said work piece (W) is initially clamped between said male forming die member (32) and said moveable support plate means (64), just prior to blanking of said opening, and said work piece (W) is blanked prior to any deformation thereof;

ejector means (38) in said male blanking die member (30), said ejector means (38) being resiliently moveable, whereby the same may be withdrawn into said blanking die member (30), upon closure of said blanking die member (30) on said work piece (W), and, after blanking of said portion of said work piece (W) by said male and female die members, said ejector means (38) being adapted to be extended from said male blanking die (30), whereby to displace said blanking out portion; and, passageway means (88) in said female die assembly (16) communicating with the interior of said female die sleeve (52) for receiving said blanked out portion of said work piece (W), whereby the same may be disposed of through said passageway means.

2. A two stage die set as claimed in claim 1 and wherein said female die assembly (16) includes a movable support plate means (64) in the form of a generally rectangular plate, edge rib means (72,72) on said plate (64), extending outwardly from opposite sides of said plate (64), and a pair of retaining rails (80,80), defining retaining ribs (82,82) interengaging with said edge ribs (72,72), said retaining rails (80,80) defining spaces enclosed by said retaining ribs (82,82), whereby said edge ribs (72,72) may move relative thereto within said spaces.

3. A two stage die set as claimed in claim 2 and including die support means (10,12) for supporting said male and female die assemblies (14,16), recess means (42,78) in said die support means (10,12), and spring means (44—44) extending between said recess means (42—42) and said male die assembly (14) and spring means (76—76) extending from said recess means (78,78) and said female die assembly (16), and means (46,84) for securing respective said male and female die assemblies (14,16) to respective said support means (10,12).

4. A two stage die set as claimed in claim 1 and including slug ejection opening means (58) in said lower semi-cylindrical die support member (12) for receiving a slug (S) from said female die, and ejecting the same.

5. A two stage die set as claimed in claim 4 and wherein said female assembly (16) includes a female hollow die sleeve (52), of regular section from top to bottom, and a female die base member (54), defining ledge means (56) engaging the lower end of said hollow die sleeve (52), and opening means (58) in said die base member (54) registering with said hollow female die sleeve (52), said die base member (54) being attachable to said die support member (12), for supporting said hollow die sleeve (52) in position, and securing means (86) for securing said hollow die sleeve (52) to said die base member (54).

6. A two stage die set as claimed in claim 5, and wherein said die base member (54) defines a generally frusto-conical shape, and wherein said movable plate means (64) defines an interior generally frusto-conical recess, shaped to substantially correspond to said frusto-conical shape of said die base (54), whereby said mounting plate means (64) may be moved over and around said die base means (54).

7. A two stage die set as claimed in claim 1 wherein said female die sleeve (52) defines in plan, a shape having at least some linear portions (92—92) and having radiussed corners (94—94) joining said linear portions (92—92), and wherein said linear portions (92—92) define a predetermined first width, and wherein said radiussed corners (94—94) define a predetermined second width less than said first width.

8. In combination with a rotary apparatus, having upper and lower rotary members, and having at least one generally semi-cylindrical die support member in each of said upper and lower rotary members, and wherein two-stage die sets having a male die assembly (14) supported on said semi-cylindrical die support member (10) of said upper rotary apparatus and a female die assembly (16) supported on said semi-cylindrical die support member (12) of said lower rotary apparatus, each of said die sets being characterized by:

a male die assembly (14), in turn comprising a male blanking die member (30) defining a make blanking edge (48);

a male forming die member (32) spaced from said male blanking die member (30) defining a male forming corner (50);

recess means (34) between said blanking die (30) and said forming die (32);

a female die assembly (16) in turn comprising a generally hollow female die sleeve member (52), said female die sleeve member (52) being shaped and dimensioned to correspond to said male blanking die member (30) and to receive the same in telescopic relation and defining inner and outer sides:

and having upper spring recess means (44, 42) in said upper semi-cylindrical die support member (10), and including lower semi-cylindrical die support member (12);

blanking edge means (60) on the inner side of said female die sleeve (52);

forming corner means (62) on the outer side of said female die sleeve (52);

a moveable female support plate means (64) located around said outer side of said female die sleeve member (52), and pressure means (76) operable on said moveable female support plate means (64), whereby to urge the same into a first position, and said moveable plate means (64) being adapted to yield to said male forming die member (32) of said male die assembly (14), when said male and female dies (14, 16) are closed together, whereby said male blanking die (30) co-operates with said female die sleeve (52) of said female die assembly (16) to blank out a portion of a work piece (W) and form an opening therein, and whereby upon further relative movement between said male and female die assemblies (14, 16) towards one another, said male forming die sleeve (32) will co-operated with said moveable support plate means (64) and said female die sleeve (52), to cause deformation of an edge portion of said work piece (W) around said opening;

wherein said female die sleeve (52) defines a predetermined first height, and wherein said movable support plate means (64), in its said first position, defines a predetermined second height, greater than said first height, whereby upon closing of said male and female die assemblies (14, 16), said work piece (W) is initially clamped between said male forming die member (32) and said moveable support plate means (64), just prior to blanking of said opening, and said work piece (W) is blanked prior to any deformation thereof;

ejector means (38) in said male blanking die member (30), said ejector means (38) being resiliently moveable, whereby the same may be withdrawn into said blanking die member (30), upon closure of said blanking die member (30) on said work piece (W), and, after blanking of said portion of said work piece (W) by said male and female die members, said ejector means (38) being adapted to be extended from said male blanking die (30), whereby to displace said blanked out portion; and, passageway means (88) in said female die assembly (16) communicating with the interior of said female die sleeve (52) for receiving said blanked out portion of said work piece (W), whereby the same may be disposed of through said passageway means.

9. The combination as claimed in claim 8 and wherein said female die assembly (16) includes a movable support plate means (64) is in the form of a generally rectangular plate, edge rib means (72,72) on said plate (64), extending outwardly from opposite sides of said plate (64), and a pair of retaining rails (80,80), defining retaining ribs (82,82) interengaging with said edge ribs (72,72), said retaining rails (80,80) defining spaces enclosed by said retaining ribs (82,82), whereby said edge ribs (72,72) may move relative thereto within said spaces.

10. The combination as claimed in claim 9 and including die support means (10,12) for supporting said male and female die assemblies (14,16), recess means (42,78) in said die support means (10,12), and spring means (44—44) extending between said recess means (42—42) and said male die assembly (14) and spring means (76—76) extending from said recess means (78,78) and said female die assembly (16), and means (46,84) for securing respective said male and female die assemblies (14,16) to respective said support means (10,12).

11. The combination as claimed in claim 10 and including slug ejection opening means (58) in said lower semi-cylindrical die support member (12) for receiving a slug (S) from said female die, and ejecting the same.

12. The combination as claimed in claim 11 and wherein said female die assembly (16) includes a female hollow die sleeve (52), of regular section from top to bottom, and a female die base member (54) defining ledge means (56) engaging the lower end of said hollow die sleeve (52), and opening means (58) in said die base member (54) registering with said hollow female die sleeve (52) said die base member (54) being attachable to said die support member (12), for supporting said hollow die sleeve (52) in position, and securing means (86) for securing said hollow die sleeve (52) to said die base member (54).

13. The combination as claimed in claim 11, and wherein said die base member (54) defines a generally frusto-conical shape, and wherein said movable plate means (64) defines an interior generally frusto-conical recess, shaped to substantially correspond to said frusto-conical shape of said die base (54), whereby said mounting plate means (64) may be moved over and around said die base means (54).

14. The combination as claimed in claim 8 wherein said female die sleeve (52) defines in plan, a shape having at least some linear portions (92—92) and having radiussed corners (94—94) joining said linear portions (92—92), and wherein said linear portions (92—92) define a predetermined first width, and wherein said radiussed corners (94—94) define a predetermined second width less than said first width.

* * * * *

UNITED STATES PATENT AND TRADEMARK OFFICE

CERTIFICATE OF CORRECTION

PATENT NO. : 5,722,280

DATED : March 3, 1998

INVENTOR(S) : Ernest Robert Bodnar

It is certified that error appears in the above-identified patent and that said Letters Patent is hereby corrected as shown below:

Claim 6, line 1, cancel the numeral "5" and substitute the numeral - 4 -.

Claim 11, line 1, cancel the numeral "10" and substitute the numeral - 3 -.

Claim 13, line 1, cancel the numeral "11" and substitute the numeral - 12 -.

Signed and Sealed this

Fifth Day of May, 1998

Bruce Lehman

*Attest:*

BRUCE LEHMAN

*Attesting Officer*

*Commissioner of Patents and Trademarks*